US010830194B2

(12) United States Patent
Shafer et al.

(10) Patent No.: US 10,830,194 B2
(45) Date of Patent: Nov. 10, 2020

(54) COMMON RAIL FUEL SYSTEM HAVING PUMP-ACCUMULATOR INJECTORS

(71) Applicant: Caterpillar Inc., Peoria, IL (US)

(72) Inventors: Scott F. Shafer, Morton, IL (US); Dennis H. Gibson, Chillicothe, IL (US); Zhenyu (Jason) Li, Peoria, IL (US); Robert Michael Campion, Chillicothe, IL (US); Alan Ray Stockner, Metamora, IL (US); Satya Naga Deepak Pillarisetti, Pontiac, IL (US); George Kodikulam Joseph, Pontiac, IL (US); Lifeng Wang, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 862 days.

(21) Appl. No.: 15/288,729

(22) Filed: Oct. 7, 2016

(65) Prior Publication Data

US 2018/0100475 A1 Apr. 12, 2018

(51) Int. Cl.

| | |
|---|---|
| ***F02M 47/02*** | (2006.01) |
| ***F02M 55/02*** | (2006.01) |
| ***F02M 63/02*** | (2006.01) |
| ***F02M 57/02*** | (2006.01) |
| ***F02D 41/38*** | (2006.01) |

(Continued)

(52) U.S. Cl.

CPC ..... *F02M 47/027* (2013.01); *F02D 41/3809* (2013.01); *F02M 55/025* (2013.01); *F02M 57/023* (2013.01); *F02M 59/022* (2013.01); *F02M 63/0007* (2013.01); *F02M 63/0225* (2013.01); *F02M 63/0265* (2013.01); *F02D 2041/389* (2013.01)

(58) Field of Classification Search

CPC ..... F02D 41/3809; F02D 2041/389; F02D 41/3836; F02M 63/0265; F02M 59/022; F02M 63/0007; F02M 47/027; F02M 63/0225; F02M 57/02; F02M 59/366; F02M 55/025; F02M 63/0275; Y02T 10/44

USPC ..... 123/456

See application file for complete search history.

(56) References Cited

U.S. PATENT DOCUMENTS 5,819,704 A * 10/1998 Tarr ..... F02M 47/027 123/467

6,439,202 B1 * 8/2002 Carroll, III ..... F02D 41/3836 123/300

(Continued)

FOREIGN PATENT DOCUMENTS

| | | |
|---|---|---|
| EP | 2 261 498 | 12/2010 |
| WO | WO 2013/160106 | 4/2013 |

*Primary Examiner* — Sizo B Vilakazi

(74) *Attorney, Agent, or Firm* — Finnegan, Henderson, Farabow, Garrett & Dunner, LLP

(57) ABSTRACT

A fuel system is disclosed for use with an engine. The fuel system may have a common rail, a first type of fuel injector fluidly connected to the common rail, and a second type of fuel injector fluidly connected to the common rail. The second type of fuel injector may include a pumping portion having a bore formed therein, and a plunger reciprocatingly disposed in the bore. The second type of fuel injector may also include an accumulator portion fluidly connected to the common rail and configured to receive fuel pushed from the bore of the pumping portion by the plunger, a nozzle portion, and a valve portion fluidly connecting the pumping, nozzle, and accumulator portions.

8 Claims, 4 Drawing Sheets

(51) Int. Cl.
*F02M 59/02* (2006.01)
*F02M 63/00* (2006.01)

(56) References Cited

U.S. PATENT DOCUMENTS

| | | | | |
|---|---|---|---|---|
| 7,077,101 | B2 * | 7/2006 | Poola | F02D 41/22 123/299 |
| 7,406,936 | B2 * | 8/2008 | Knight | F02M 55/00 123/468 |
| 7,418,941 | B2 * | 9/2008 | Music | F02D 41/2409 123/299 |
| 7,509,942 | B2 * | 3/2009 | Knight | F02M 55/025 123/456 |
| 7,574,995 | B2 * | 8/2009 | Graham | F02M 47/027 123/456 |
| 7,835,852 | B2 * | 11/2010 | Williams | F02D 41/221 123/478 |
| 7,926,469 | B2 * | 4/2011 | Millet | F02M 45/12 123/447 |
| 2014/0338637 | A1 | 11/2014 | Shafer et al. | |
| 2015/1009653 | | 4/2015 | Graham | |

* cited by examiner

COMMON RAIL FUEL SYSTEM HAVING PUMP-ACCUMULATOR INJECTORS

TECHNICAL FIELD

The present disclosure is directed to a fuel system and, more particularly, to a common rail fuel system having pump-accumulator-injectors.

BACKGROUND

Internal combustion engines such as diesel engines and gasoline engines use injectors to introduce fuel into combustion chambers of the engine. Two types of fuel systems are commonly used in modern engines, including a common rail (CR) fuel system and a mechanical unit injector (MUI) fuel system.

A CR fuel system includes a centralized high-pressure pump that feeds pressurized fuel to an accumulator (a.k.a., rail), and a plurality of electronically controlled fuel valves that are supplied with fuel by the accumulator. When a fuel valve inside each injector opens, pressurized fuel from the accumulator flows through an injector nozzle and sprays into an associated combustion chamber.

In contrast to a CR system, a MUI system does not include a centralized high-pressure pump. Instead, the MUI system relies on a cam-driven unit pump for each injector. As a cam rotates to push a lobe against a plunger of the unit pump, high-pressure fuel is forced from the unit pump through an injector nozzle and into an associated combustion chamber.

Competition and government regulations force engine manufacturers to continually improve engine performance, with respect to power, fuel efficiency, and emissions. One way to improve engine performance is to increase fuel injection pressure while also decreasing fuel injection duration. Conventional CR and MUI fuel systems struggle to provide the required higher-pressures within the shorter injection durations.

One attempt to provide a higher performing fuel system is disclosed in U.S. Pat. No. 7,077,101 of Poola et al. that issued on Jul. 18, 2006 ("the '101 patent"). In particular, the '101 patent discloses a hybrid fuel injection system having CR components (i.e., a high-pressure pump that feeds an accumulator or rail) and MUI components (i.e., unit-pump injectors that communicate with the rail). With this arrangement, fuel from the unit pump provides for the main injection of the fuel injector, while fuel from the accumulator provides fuel for one or more auxiliary fuel injections.

Although the hybrid system of the '101 patent may exhibit benefits of a combined CR and MUI system, it may still be less than optimal. In particular, the system may be complex and expensive. In addition, the hybrid system may lack design flexibility and have limited retrofitting capabilities with respect to existing engines.

The fuel system of the present disclosure solves one or more of the problems set forth above.

SUMMARY

One aspect of the present disclosure is directed to a fuel injector for a fuel system having a common rail. The fuel injector may include a pumping portion having a bore formed therein, and a plunger reciprocatingly disposed in the bore. The fuel injector may also include an accumulator portion fluidly connectable to the common rail and configured to receive fuel pushed from the bore of the pumping portion by the plunger. The fuel injector may further include a nozzle portion, and a valve portion connecting the pumping, nozzle, and accumulator portions.

Another aspect of the present disclosure is directed to fuel system. The fuel system may include a common rail, a first type of fuel injector fluidly connected to the common rail, and a second type of fuel injector fluidly connected to the common rail. The second type of fuel injector may include a pumping portion having a bore formed therein, and a plunger reciprocatingly disposed in the bore. The second type of fuel injector may further include an accumulator portion fluidly connected to the common rail and configured to receive fuel pushed from the bore of the pumping portion by the plunger, a nozzle portion, and a valve portion fluidly connecting the pumping, nozzle, and accumulator portions.

In yet another aspect, the present disclosure is directed to an engine. The engine may include an engine block at least partially defining a plurality of cylinders, a piston disposed within each of the plurality of cylinders, and at least one cylinder head configured to close off the plurality of cylinders and thereby form a plurality of combustion chambers. The engine may also include a common rail, a first type of fuel injector disposed at least partially within the at least one cylinder head and configured to inject fuel received from the common rail into a first of the plurality of combustion chambers, and a second type of fuel injector disposed at least partially within the at least one cylinder head and configured to pump fuel into the common rail and to inject fuel into a second of the plurality of combustion chambers. Each of the first and second types of fuel injectors may include an accumulator portion configured to hold pressurized fuel for subsequent injection events. The second type of fuel injector may further include a pumping portion having a bore formed therein, a plunger reciprocatingly disposed in the bore, the accumulator portion fluidly connected to the common rail and configured to receive fuel pushed from the bore of the pumping portion by the plunger, a nozzle portion, and a valve portion fluidly connecting the pumping, nozzle, and accumulator portions.

DETAILED DESCRIPTION

Figure 1:
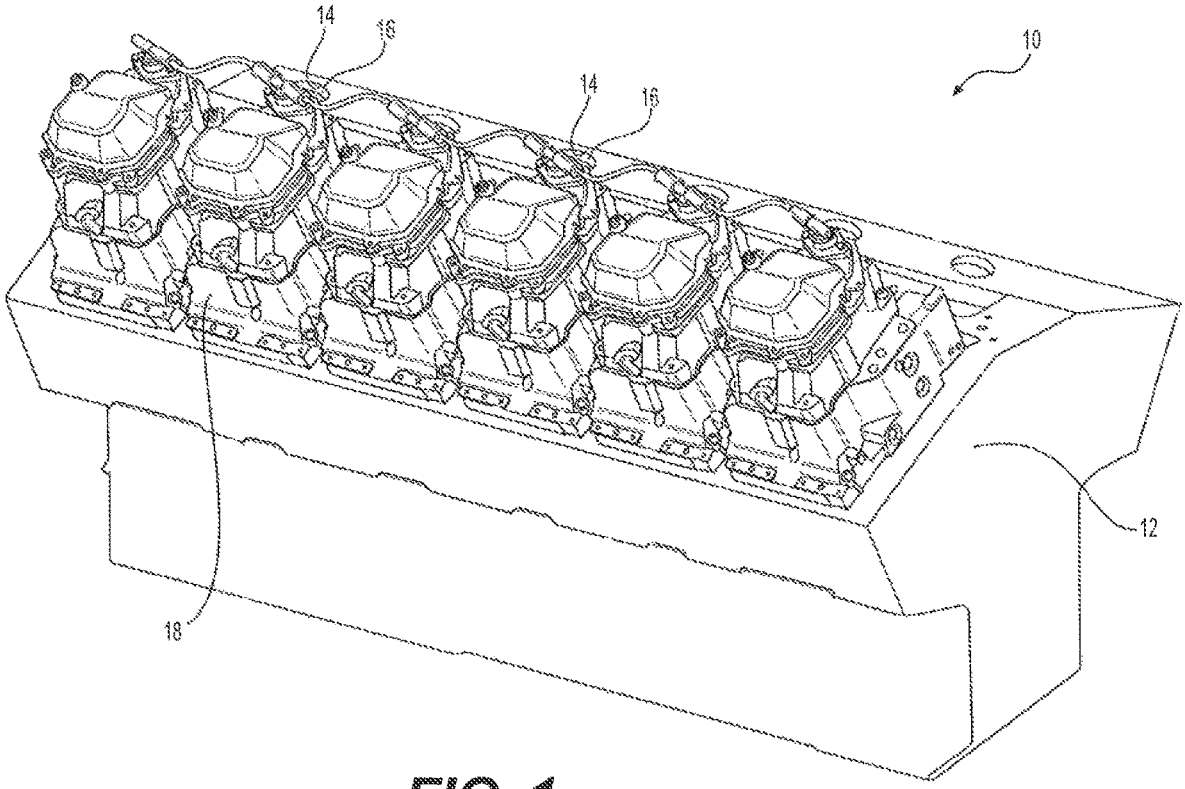
FIG. 1 is a perspective illustration of an exemplary disclosed engine.

FIG. 1 illustrates an engine 10. For the purposes of this disclosure, engine 10 is depicted and described as a four-stroke diesel engine. One skilled in the art will recognize, however, that engine 10 may be any other type of internal combustion engine such as, for example, a gasoline engine. Engine 10 may include an engine block 12 that at least partially defines a plurality of cylinders 14, a piston slidably 16 disposed within each cylinder 14, and a cylinder head 18 associated with each cylinder 14.

Figure 2:
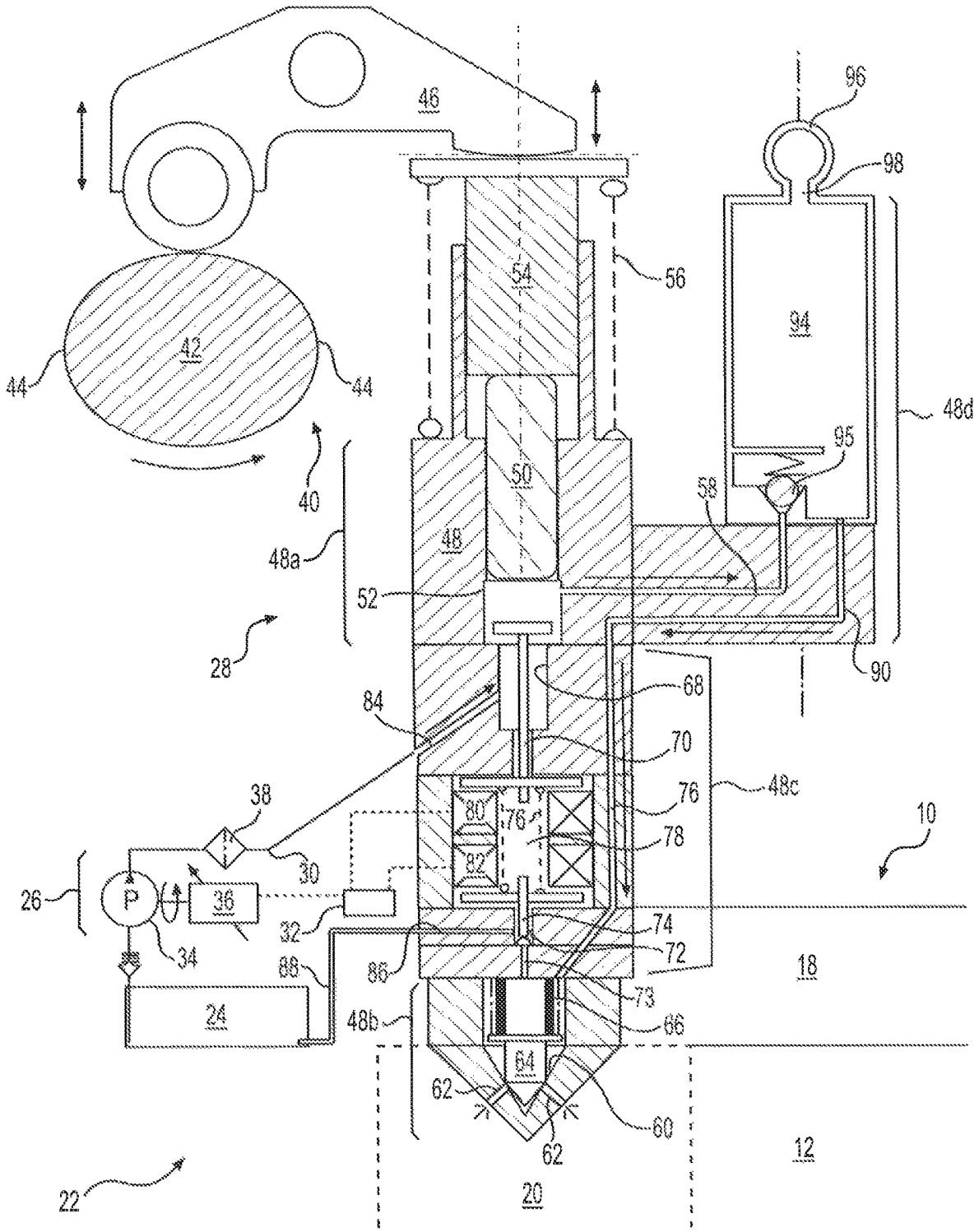
FIG. 2 is a schematic and diagrammatic illustration of an exemplary disclosed fuel system that may be used in conjunction with the engine of FIG. 1.

Cylinder 14, piston 16, and cylinder head 18 may together form a combustion chamber 20 (shown only in FIG. 2). In the illustrated embodiment, engine 10 includes twelve combustion chambers 20 arranged in a "V"-configuration. However, it is contemplated that engine 10 may include a greater or lesser number of combustion chambers 20 and that combustion chambers 20 may be disposed in an "in-line" configuration, in an "opposing-piston" configuration, or in any other suitable configuration.

As shown in FIG. 2, a fuel system 22 may be associated with engine 10 and include components that cooperate to deliver injections of pressurized fuel into each combustion chamber 20. These components may include, among other things, a tank 24 configured to hold a supply of fuel, a fuel pumping arrangement 26 configured to pressurize the fuel and direct the pressurized fuel to a plurality of fuel injectors 28 (only one shown in FIG. 2) by way of a one or more supply passages 30, and a controller 32 in communication with pumping arrangement 26 and fuel injectors 28.

Fuel pumping arrangement 26 may include one or more pumping devices that function to increase the pressure of the fuel and direct one or more pressurized streams of fuel into supply passage(s) 30. In one example, fuel pumping arrangement 26 includes a low-pressure source 34. Low-pressure source 34 may embody, for example, a transfer pump that is powered by a variable speed electric motor 36 to provide low-pressure feed to injectors 28 via passage(s) 30. A filter 38 may be disposed within fuel line(s) 30, if desired. It is contemplated that fuel pumping arrangement 26 may include additional and/or different components than those listed above such as, for example, a high-pressure source disposed in series with or used in place of low-pressure source 34.

An exemplary fuel injector 28 is illustrated in FIG. 2 as being disposed at least partially within a corresponding cylinder head 18. In this example, fuel injector 28 is mechanically driven by a cam arrangement 40 to selectively pressurize fuel within fuel injector 28 to a desired pressure level for use in future injection events. Cam arrangement 40 may include a cam 42 operatively connected to a crankshaft (not shown) of engine 10 such that a rotation of the crankshaft results in a corresponding rotation of cam 42. During rotation of cam 42, one or more lobes 44 may periodically drive a pumping action of fuel injector 28 via a pivoting rocker arm 46. It is contemplated that the pumping action of fuel injector 28 may alternatively be driven directly by lobe(s) 44 without the use of rocker arm 46 or that a pushrod (not shown) may be disposed between rocker arm 46 and fuel injector 28, if desired.

Fuel injector 28 may include multiple components that interact to pressurize and inject fuel into combustion chamber 20 of engine 10 in response to the driving motion of cam arrangement 40. In particular, each fuel injector 28 may include an injector body 48 divided into or otherwise enclosing a pumping portion 48*a*, a nozzle portion 48*b*, a valve portion 48*c* located between pumping and nozzle portions 48*a* and 48*b*, and an accumulator portion 48*d*. The driving motion of cam arrangement 40 described above may result in low-pressure fuel being drawn from passage 30 into pumping portion 48*a*, and high-pressure fuel being discharged from pumping portion 48*a* into accumulator portion 48*d*. Nozzle portion 48*b* may selectively discharge high-pressure fuel received from accumulator portion 48*d* into combustion chamber 20. Valve portion 48*c* may regulate various flows of fuel between the other portions of injector body 48.

Pumping portion 48*a* may include a plunger 50 reciprocatingly disposed within a bore 52. Plunger 50 may be operatively connected to rocker arm 46 via a tappet 54. Tappet 54 may be retained in continuous engagement with rocker arm 46 by a plunger spring 56. Low-pressure fuel may flow from valve portion 48*c* into bore 52 of pumping portion 48*a* during a retracting (e.g., upward) stroke of rocker arm 46, tappet 54, and plunger 50. High-pressure fuel may be forced from bore 52 into accumulator portion 48*d* via a discharge passage 58 during a contracting (e.g., downward) stroke of rocker arm 46, tappet 54, and plunger 50.

Nozzle portion 48*b* may be located at least partially inside cylinder head 18 and include an internal pressure chamber 60 that is fluidly connected with combustion chamber 20 via one or more orifices 62. A valve needle 64 may be reciprocatingly disposed within chamber 20 and movable from a first or closed position (shown in FIG. 2) to a second or open position (not shown). When valve needle 64 is in the closed position, orifices 62 may be blocked from combustion chamber 20 by a tip end of valve needle 64. When valve needle 64 is in the open position, fuel may flow from chamber 60 through orifices 62 unimpeded by valve needle 64. A needle spring 66 may urge valve needle 64 toward the closed position.

Valve portion 48*c* may connect plunger portion 48*a* with nozzle and accumulator portions 48*c*, 48*d*, and also contain one or more valves that facilitate fuel flows therebetween. In the disclosed example, valve portion 48*c* includes a spill chamber 68 open to bore 52 of plunger portion 48*a*, a spill valve 70 associated with spill chamber 68, a control chamber 72 fluidly connected with pressure chamber 60 of nozzle portion 48*b* (e.g., via a restricted orifice 73), a control valve 74 associated with control chamber 72, a spring 76 disposed within a spring chamber 78 between spill and control valves 70 and 74, a first electrical actuator 80 configured to control movements of spill valve 70, and a second electrical actuator 82 configured to control movements of control valve 74. An inlet passage 84 may fluidly connect supply passage 30 with spill chamber 68. An outlet passage 86 may fluidly connect control chamber 72 with a return line 88 that leads back to tank 24. An accumulator passage 90 may extend from accumulator portion 48*d* through valve portion 48*c* to pressure chamber 60 of nozzle portion 48*b*.

First and second actuators 80, 82 may be selectively energized by controller 32 to cause movements of spill and control valves 70, 74, respectively. In particular, spill valve 70 may be moved from a first or open position (shown in FIG. 2) to a second or closed position (not shown) when first actuator 80 is energized, and spring-biased (e.g., via spring 76) back toward the open position when first actuator 80 is de-energized. In contrast, control valve 74 may be moved from a first or closed position (shown in FIG. 2) to a second or open position (not shown) when second actuator 82 is energized and spring-biased (e.g., via spring 76) back toward the closed position when second actuator 82 is de-energized.

When spill valve 70 is in the open position during a retracting stroke of plunger 50, low-pressure fuel may be forced and/or drawn into bore 52 via inlet passage 84 and spill chamber 68. When spill valve 70 is in the closed position during a contracting stroke of plunger 50, high-pressure fuel may be inhibited by spill valve 70 from passing through spill chamber 68 and inlet passage 84, thereby forcing the displacing fuel to instead flow through passage 58 and into accumulator portion 48*d*. However, when spill valve 70 is in the open position during the contracting stroke, some or all of the fuel being displaced from bore 52 by plunger 50 may be allowed to "spill" through spill chamber 68 and inlet passage 84. When fuel forced from bore 52 is allowed to exit fuel injector 28 via inlet passage 84, the buildup of pressure within fuel injector 28 due to contracting stroke of plunger 50 may be minimal. Accordingly, by timing an opening and closing of spill valve 70 relative to the strokes of plunger 50, an amount and/or pressure of the fuel being displaced by plunger 50 and directed into accumulator portion 48*d* may be regulated by controller 32.

When control valve 74 is in the open position, high-pressure fuel at a base end of valve needle 64 may be allowed to drain through restricted orifice 73, control chamber 72, outlet passage 86, and return line 88 to tank 24. As the fluid pressure at the base end of valve needle 64 drops with the draining fuel, the high-pressure fuel acting at a tip end of valve needle 64 may create a pressure imbalance that forces valve needle 64 upward against the bias of spring 66 to the open position at which fuel discharge from injector 28 begins. When control valve 74 is in the closed position, pressure may build at the base end of valve needle 64, thereby balancing pressures across valve needle 64 and allowing spring 66 to move valve needle 64 to the closed position to stop fuel injection. Accordingly, by timing an opening and closing of control valve 74, a fuel injection time, amount and/or pressure may be regulated by controller 32.

First and second electrical actuators 80, 82 may each include a solenoid, and an armature fixedly connected to the respective valve (e.g., to spill valve 70 or to control valve 74). The solenoid may include windings of a suitable shape and/or size through which current may flow to establish a magnetic field that, when energized, draws the corresponding armature toward itself. It is contemplated that first and/or second electrical actuators 80, 82 may embody another type of actuator (e.g., a piezo motor), if desired. It is further contemplated that first and second electrical actuators 80, 82 may be combined in some embodiments.

Accumulator portion 48*d* may be rigidly connected to plunger and/or valve portions 48*a*, 48*c* of injector body 48. In one embodiment, accumulator portion 48*d* may be generally cylindrical and have a center axis that is offset from and parallel to a center axis of pumping, nozzle, and valve portions 48*a*, 48*b*, and 48*c*. In some embodiments, accumulator portion 48*d* may be integrally formed (e.g., cast, machined, printed, etc.) with one or both of pumping and valve portions 48*a*, 48*c*. Accumulator portion 48*d* may include, among other things, a pressure chamber 94 configured to collect high-pressure fuel pushed from bore 52 by plunger 50. The high-pressure fuel of bore 52 may pass from discharge passage 58 through a check valve (e.g., a spring-biased check valve) 95 before entering pressure chamber 94. Pressure chamber 94 may be fluidly connected with pressure chamber 60 of nozzle portion 48*b* via accumulator passage 90. Pressure chamber 94, on the disclosed example, has a volume that is greater than an amount of fuel injected during any one injection event by a single injector 28 (e.g., 15 to 50 times greater), such that one injection event does not exhaust a supply of fuel stored within pressure chamber 94. For the purposes of this disclosure, an injection event may be considered to include all fuel injections by a single fuel injector 28 during a complete combustion cycle of engine 10.

Figure 3:
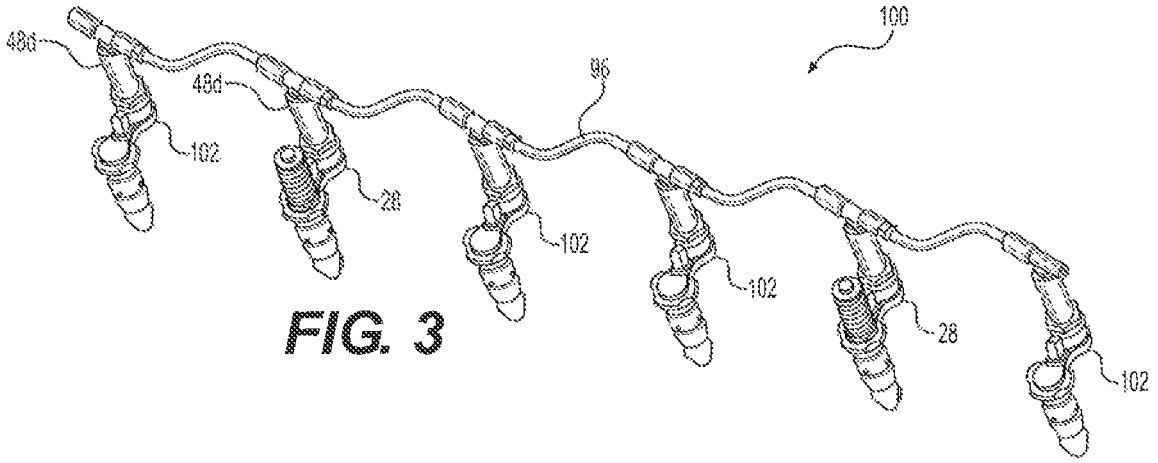
FIGS. 3 and 4 are perspective illustrations of exemplary disclosed portions of the fuel system of FIG. 2.
Figure 4:
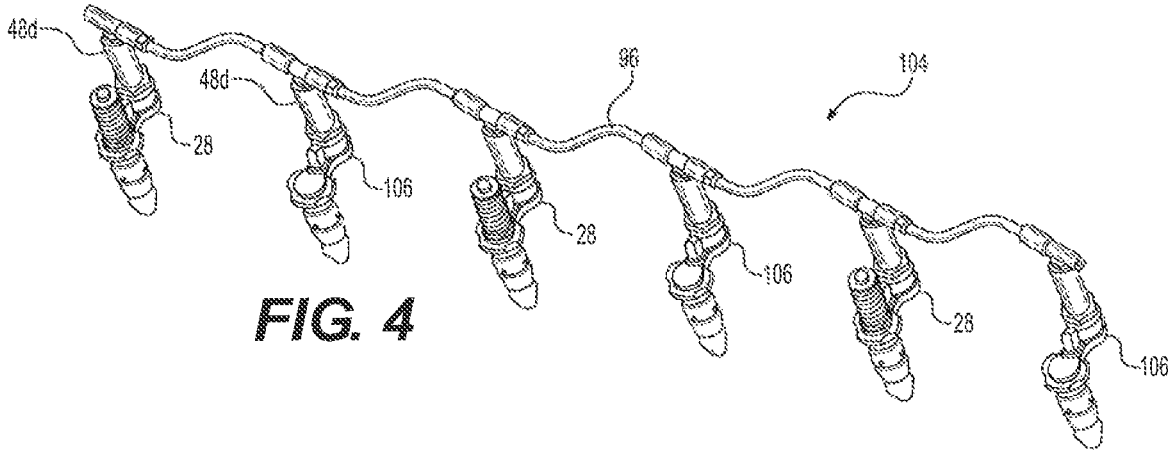

As shown in FIGS. 2-4, the pressure chamber 94 of one fuel injector 28 may be connected to the pressure chamber of another fuel injector 28, in some embodiments. For example, a common rail 96 may extend between accumulator portions 48*d* of multiple fuel injectors 28, if desired. In some instances, a restricted orifice 98 may be located between common rail 96 and each pressure chamber 94 to help reduce the generation of pressure fluctuations within common rail 96.

FIG. 3 illustrates an exemplary fuel injector arrangement ("arrangement") 100 that may be used in some fuel system configurations of engine 10. As can be seen in this figure, one or more fuel injectors 28 may be interspersed with one or more other types of fuel injectors and connected to each other via common rail 96. In the specific example of arrangement 100 shown in FIG. 3, two fuel injectors 28 are fluidly connected to four other fuel injectors 102 of a different type. In particular, arrangement 100 includes twice as many fuel injectors 102 as fuel injectors 28, wherein each fuel injector 28 is fluidly located between two fuel injectors 102. In addition, two fuel injectors 102 are shown as being located immediately adjacent each other at a center of arrangement 100; and terminal ends of arrangement 100 are connected to fuel injectors 102. It should be noted that engine 10 may include two of arrangements 100, with each arrangement 100 being associated with a separate bank of cylinders 14 (referring to FIG. 1).

FIG. 4 illustrates another exemplary fuel injector arrangement ("arrangement") 104 that may be used in some fuel system configurations of engine 10. As can be seen in this figure, one or more fuel injectors 28 may be interspersed with one or more other types of fuel injectors and connected to each other via common rail 96. In the specific example of arrangement 104 shown in FIG. 4, three fuel injectors 28 are fluidly connected to three other fuel injectors 102 of a different type. In particular, arrangement 104 includes an equal number of fuel injectors 28 and 102, with the location of each type of fuel injector alternating along a length of arrangement 104. In addition, a first terminal end of arrangement 104 is connected to fuel injector 28, while an opposing terminal end of arrangement 104 is connected to fuel injector 102. It should be noted that engine 10 may include two of arrangements 104, wherein each arrangement 104 is associated with a separate bank of combustion cylinders 14 (referring to FIG. 1). It is contemplated, however, that in some embodiments, two different fuel injector arrangements could be utilized, if desired.

Figure 5:
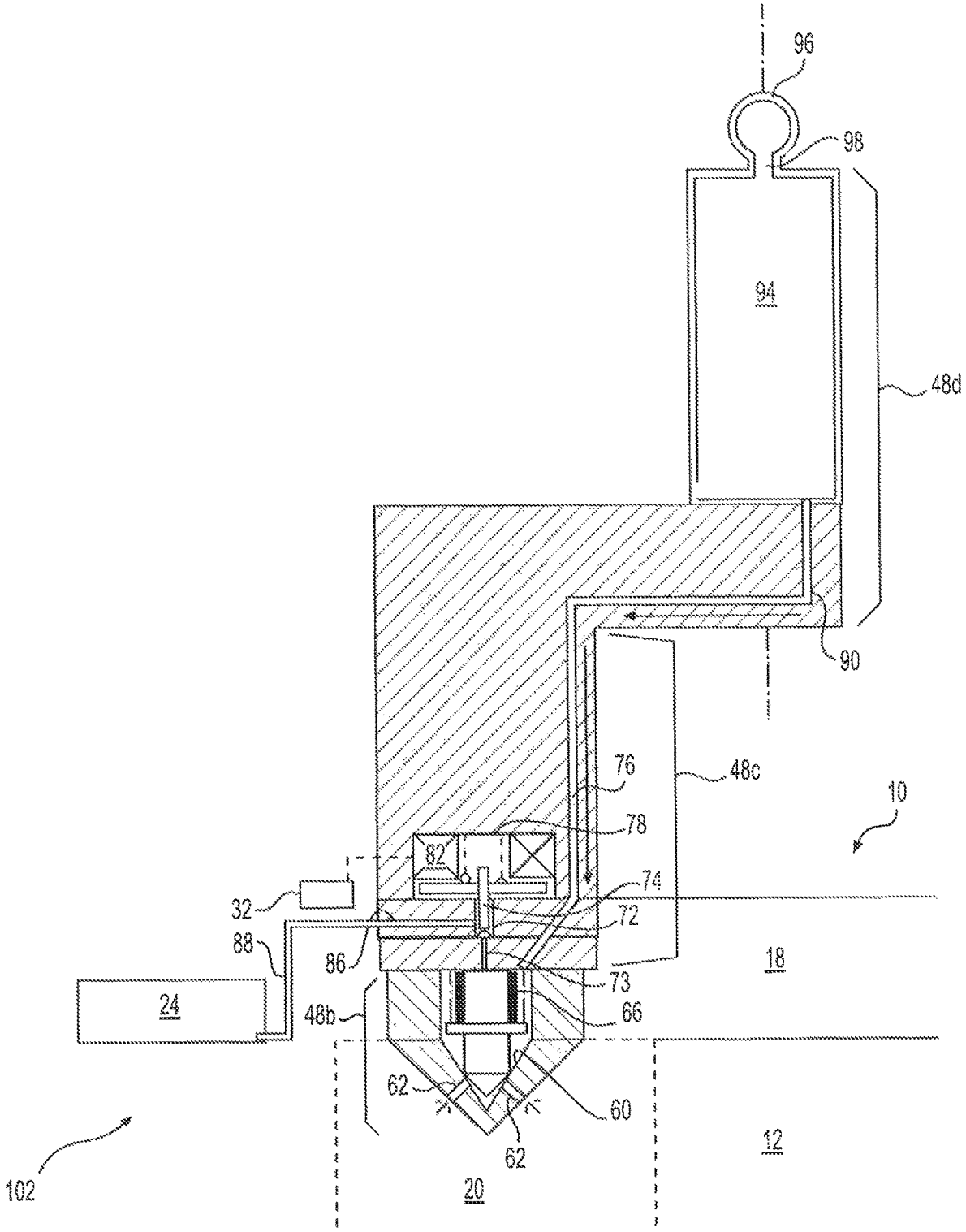
FIG. 5 is a schematic and diagrammatic illustration of an exemplary disclosed fuel injector that may be used in conjunction with the fuel system of FIG. 2.

As shown in FIG. 5, fuel injector 102 may be similar to fuel injector 28 in many respects. For example, fuel injector 102 may include nozzle portion 48*b*, valve portion 48*c*, and accumulator portion 48*d*. In fact, pressure chamber 94 of each fuel injector 28 may be fluidly connected via common rail 96 to a substantially identical pressure chamber 94 of an adjacent fuel injector 102. However, in contrast to fuel injector 28, fuel injector 102 may not include pumping portion 48*a*. That is, fuel injector 102 may be a simpler common rail type of fuel injector that is configured to inject high-pressure fuel received only from common rail 96. Fuel injector 102 may not internally increase a fuel pressure in the way that fuel injectors 28 do. In addition, the components of fuel injector 28 normally used to regulate fuel pumping (e.g., spill chamber 68, spill valve 70, electrical actuator 80, and inlet passage 84) may be omitted from valve portion 48*c* of fuel injector 102.

Because fuel injectors 102 may not internally pressurize fuel for injection, the fuel pressurized by fuel injectors 28 must be sufficient to provide for the injection needs of all fuel injectors connected in the same arrangement. Accordingly, each fuel injector 28 of arrangement 100 (referring to FIG. 3) may be required to pressurize three times as much fuel (or more) as is self-injected. Similarly, each fuel injector 28 of arrangement 104 (referring to FIG. 4) may be required to pressurize twice as much fuel (or more) as is self-injected.

INDUSTRIAL APPLICABILITY

The fuel injector and system of the present disclosure have wide application in a variety of engine types including, for example, diesel engines and gasoline engines. The disclosed fuel injector and system may facilitate high performance of the associated engine in a simple, flexible, and low-cost configuration. Operation of system 22 will now be explained.

A controlled injection event may start by first receiving an indication of a desired start of injection (SOI) timing, a desired injection amount, a desired SOI pressure, and/or a desired end of injection (EOI) pressure. For example, engine 10 may request an SOI corresponding to a particular position of piston 16 within cylinder 14. Similarly, engine 10 may request a specific quantity of fuel, an SOI pressure, and/or an EOI pressure. These requested (e.g., desired) injection characteristics may be received by controller 32 (referring to FIG. 2) in preparation for the injection event.

After receiving the desired fuel injection characteristics, controller 32 may determine a start of current (SOC) for second electrical actuator 82 that will move control valve 74 to the open position and initiate injection at the desired SOI timing. As indicated above, movement of control valve 74 toward the energized flow-passing position may cause an imbalance of pressure that moves valve needle 64 toward the orifice-opening position, thereby initiating injection of fuel into combustion chamber 20. Controller 32 may determine the SOC by offsetting the desired SOI by system delays associated with control valve 74 and valve needle 64.

Controller 32 may determine an EOI timing that corresponds with injection of the desired quantity of fuel. Using known kinematics of nozzle and valve portions 48*c* and 48*d* and based on known or assumed fuel pressures inside accumulator portion 48*d* and/or common rail 96, controller 32 may calculate a delay after SOI required for the desired amount of fuel to pass through orifices 62. Controller 32 may then calculate an end of current (EOC) that accounts for delays associated with control valve 74 such that by the end of the injection at the determined EOI timing, the proper amount of fuel has been injected into combustion chamber 20.

Controller 32 may end injection by terminating the current supplied to second electrical actuator 82 at the calculated EOC timing such that control valve 74 moves to the closed position in time for the pressures acting on valve needle 64 to balance and allow movement thereof back to block orifices 62 at the EOI timing.

Because the fuel injected through orifices 62 may be linked primarily to a pressure of fuel within pressure chamber 94 of accumulator portion 48*d* (i.e., and not necessarily linked to pumping operations of plunger 50), fuel injecting by injectors 28 may be performed somewhat independent of fuel pumping. For example, controller 32 may determine a SOC for first electrical actuator 80 associated with spill valve 70 that results in a desired pressure inside of pressure chamber 94 of accumulator portion 48*d* and/or inside of common rail 96, regardless of when fuel is being injected. As indicated above, the amount of displacement of plunger 50 into bore 52 after spill valve 70 has been moved to the flow-blocking position may correspond to an amount of fuel displaced into pressure chamber 94 and a resulting pressure. Controller 32 may be programmed with geometric relationships between an angular position of cam arrangement 40, a stroke length and area of plunger 52, and/or a displacement position of plunger 50 within bore 52. From these geometric relationships and the desired displacement amount and/or resulting pressure, controller 32 may calculate a SOC for first electrical actuator 80 (e.g., in terms of crank angle, cam angle, and/or displacement position of plunger 50). When plunger 50 moves through the subsequent displacement, a desired amount of fuel may be pushed from bore 52 to raise a pressure inside of chamber 94 to a desired level. Controller 32 may be further configured to account for delays associated with spill valve 70 when determining SOC of first electrical actuator 80.

The disclosed arrangement may be simple and inexpensive. In particular, fuel injectors 102 may have fewer control requirements and cost less than fuel injectors 28 because they do not have pumping capabilities. Accordingly, because arrangements 100 and 104 may allow use of only a limited number of fuel injectors 28 (i.e., and a greater number of fuel injectors 102), the corresponding arrangements may be simpler and less expensive than if arrangements 100 and 104 utilized only fuel injectors 28.

In addition, because the pumping action of fuel injectors 28 may be at least somewhat independent of the injecting action, the pumping action may occur over a greater period of time during each combustion cycle. That is, the pumping action may not be limited to only a period during which fuel is injected. This separation of pumping from injection may allow for the torque associated with the pumping action to be spread over a greater amount of time (and a greater amount of cam surface area), resulting in a lower peak torque and less wear. A lower peak torque passing through cam arrangement 40 during pumping may improve longevity of cam arrangement 40. In addition, the separation of pumping from injection may allow for as short of an injection duration as desired.

Finally, injector 28 may be used alone and placed within each cylinder head 18 of engine 10, or used together in a connected arrangement with other injectors of the same or a different type. This may allow for flexibility in designing engine 10, as well as retrofitting of existing engines with complex supply and/or routing requirements.

It will be apparent to those skilled in the art that various modifications and variations can be made to the fuel system and injector of the present disclosure without departing from the scope of the disclosure. Other embodiments will be apparent to those skilled in the art from consideration of the specification and practice of the fuel system and injector disclosed herein. It is intended that the specification and examples be considered as exemplary only, with a true scope of the disclosure being indicated by the following claims and their equivalents.

What is claimed is:

1. A fuel system, comprising:

a common rail;

a first type of fuel injector fluidly connected to the common rail; and a second type of fuel injector fluidly connected to the common rail, wherein the first type of fuel injector does not have an internal pumping portion and is not configured to internally increase the pressure of fuel for fuel injection by the first type of fuel injector, and wherein the second type of fuel injector includes:

a pumping portion having a bore formed therein;

a plunger reciprocatingly disposed in the bore;

an accumulator portion fluidly connected to the common rail and configured to receive fuel pushed from the bore of the pumping portion by the plunger;

a nozzle portion; and a valve portion fluidly connecting the pumping, nozzle, and accumulator portions.

2. The fuel system of claim 1, wherein the second type of fuel injector is configured to pump fuel into the common rail for injection by only the first type of fuel injector.

3. The fuel system of claim 2, wherein the first type of fuel injector is configured to inject fuel received from only the common rail.

4. The fuel system of claim 3, wherein the first type of fuel injector includes an accumulator portion fluidly connected to the common rail.

5. The fuel system of claim 2, wherein:

the common rail is fluidly connected to a plurality of the first type of fuel injector and to a plurality of the second type of fuel injector; and a number of the second type of fuel injectors fluidly connected to the common rail is less than a number of the first type of fuel injectors fluidly connected to the common rail.

6. The fuel system of claim 5, wherein:

the number of the first type of fuel injectors is twice the number of the second type of fuel injectors;

each of the second type of fuel injectors is connected to the common rail between adjacent fuel injectors of the first type; and terminal ends of the common rail are connected to the first type of fuel injectors.

7. The fuel system of claim 2, wherein:

the common rail is fluidly connected to a plurality of the first type of fuel injector and to a plurality of the second type of fuel injector; and a number of the second type of fuel injectors fluidly connected to the common rail is about equal to a number of the first type of fuel injectors fluidly connected to the common rail.

8. An internal combustion engine, comprising:

an engine block at least partially defining a plurality of cylinders;

a piston disposed within each of the plurality of cylinders;

at least one cylinder head configured to close off the plurality of cylinders and thereby form a plurality of combustion chambers;

a common rail;

a first type of fuel injector disposed at least partially within the at least one cylinder head and configured to inject fuel received from the common rail into a first of the plurality of combustion chambers, wherein the first type of fuel injector does not have an internal pumping portion and is not configured to internally increase the pressure of fuel for fuel injection by the first type of fuel injector; and a second type of fuel injector disposed at least partially within the at least one cylinder head and configured to pump fuel into the common rail and to inject fuel into a second of the plurality of combustion chambers, wherein:

each of the first and second types of fuel injectors include an accumulator portion configured to hold pressurized fuel for subsequent injection events; and the second type of fuel injector further includes:

a pumping portion having a bore formed therein;

a plunger reciprocatingly disposed in the bore;

the accumulator portion fluidly connected to the common rail and configured to receive fuel pushed from the bore of the pumping portion by the plunger;

a nozzle portion; and a valve portion fluidly connecting the pumping, nozzle, and accumulator portions.

* * * * *